US005593266A

United States Patent [19]

Wurzinger

[11] Patent Number: 5,593,266

[45] Date of Patent: Jan. 14, 1997

[54] MECHANICAL PARKING ARRANGEMENT

[75] Inventor: Vinzenz Wurzinger, Untergriesbach, Germany

[73] Assignee: Vinzenz Maschinebau GmbH, Untergriesbach, Germany

[21] Appl. No.: 526,004

[22] Filed: Sep. 8, 1995

Related U.S. Application Data

[63] Continuation of PCT/EP94/00752, Mar. 10, 1994.

[30] Foreign Application Priority Data

Mar. 10, 1993 [DE] Germany ..... 43 07 450.7

[51] Int. Cl.[6] ..... E04H 6/12

[52] U.S. Cl. ..... 414/228; 414/234; 414/242

[58] Field of Search ..... 414/227–230, 414/234, 235, 239, 240, 242

[56] References Cited

U.S. PATENT DOCUMENTS

| | | | |
|---|---|---|---|
| 1,882,656 | 10/1932 | Creedon | 414/242 X |
| 2,579,688 | 12/1951 | McCormick | 414/228 X |
| 3,027,024 | 3/1962 | Baume | 414/240 |
| 3,155,246 | 11/1964 | Baume | 414/240 X |
| 3,405,795 | 10/1968 | Masgherpa | 414/235 |
| 3,941,257 | 3/1976 | Matsuura | 414/229 X |
| 5,158,413 | 10/1992 | Wu | 414/228 |

FOREIGN PATENT DOCUMENTS

| | | | |
|---|---|---|---|
| 223536 | 9/1962 | Austria | 414/229 |
| 510316 | 10/1992 | European Pat. Off. | 414/228 |
| 1140697 | 12/1962 | Germany . | |
| 1904755 | 11/1964 | Germany . | |
| 1231875 | 1/1967 | Germany . | |
| 2455537 | 5/1976 | Germany . | |
| 4114746 | 11/1992 | Germany . | |
| 118154 | 5/1993 | Japan | 414/228 |
| 118153 | 5/1993 | Japan | 414/240 |
| 998458 | 7/1965 | United Kingdom | 414/229 |

*Primary Examiner*—David A. Bucci
*Attorney, Agent, or Firm*—Helfgott & Karas, P.C.

[57] ABSTRACT

A mechanical parking arrangement comprises at least two parking spaces. A platform (10) for at least one vehicle may be moved by a driving arrangement, is located in the parking position above at least one underlying vehicle parking space (6) and may be lowered down to a loading position (B) in which it is substantially on a level with the access path (5). On each longitudinal side of the parking arrangement is provided a guiding rail (4) which extends over a substantial part of the length of the parking arrangement, above the under lying parking space (6) and upon which is guided a front supporting element for the platform (10). Rear supporting elements are further provided upon which the platform (10) is supported in its parking position and during a first part of its descent. The guiding rails (4) at the rear end of the underlying parking space (6) substantially begin at the level of the access path (5). The platform (10) has wheels in the area of its rear end. During the second part of the platform descent, the wheels (19) lie on the access path, discharging the rear supporting elements. In its loading position, the platform (10) takes a substantially horizontal position.

13 Claims, 6 Drawing Sheets

MECHANICAL PARKING ARRANGEMENT

This application is a continuation of PCT application PCT/EP94/00752; filed Mar. 10, 1994.

BACKGROUND OF THE INVENTION

The present invention relates to a mechanical parking facility with at least two parking places, a platform, which can be moved by a driving mechanism, being provided for at least one vehicle, which platform can be moved with a vehicle parked on it and, in the parked position, is above at least one vehicle parking place below and can be lowered into a loading position, in which it is essentially level with the driveway, a guide rail being provided at each longitudinal side of the parking facility, which guide rail extends over a significant portion of the length of the parking facility above the lower parking place and to which a front supporting element for the platform, which is contained in the parking facility, is assigned and furthermore, rear supporting elements being provided, on which the platform is supported in its parked position as well as during a first part of the lowering motion.

Such a mechanical parking facility is known from U.S. Pat. No. 3,277,978. The platform for the vehicle is guided in a total of four guiding devices, one guiding device for a front supporting wheel and one guiding device for a rear supporting wheel being provided on each side of the platform. The guiding devices, provided for the front supporting wheels and the rear supporting wheels, run parallel to one another so that the platform, loaded with a vehicle, can be shifted in parallel according to the principle of an angular elevator between a loading position, disposed behind the lower parking place, trod a parked position, disposed above the lower parking place.

The guiding devices, assigned to the front supporting wheels, are constructed to commence about a vehicle length behind the rear end of the lower parking place; the guiding devices, assigned to the rear supporting elements, protrude approximately an additional vehicle length towards the rear. Appreciable space is thus lost for the ramp-like guiding devices, The known parking device for two vehicles requires almost the same surface area as three conventional parking spaces. This makes the known parking facility unsuitable for installation in a conventional garage. Moreover, the rear guiding devices impede opening the vehicle doors when the vehicle has been driven onto the platform lowered into the loading position.

From the DE-B-1231875, a mechanical parking facility with two superimposed parking spaces is known, the upper parking space of which can be reached by way of a moveable driveway ramp. When not in use, the driveway ramp can be brought into a protected position, in that it can be pushed under the ceiling of the lower parking space. At the rear end of the ramp, wheels are provided, with which the ramp rests in the extended position on the driveway for the lower parking place. It is a disadvantage of this parking facility that the upper parking space also requires a relatively large height, since the vehicle steering bar must be able to move there. Moreover, the danger exists that the vehicles with little clearance would catch on the transition from the ramp to the upper parking place.

A further mechanical parking facility is known from the German Offenlegungsschrift 2455537. In the case of this parking facility, the platform rests in its parked position as well as during the first section of the lowering motion into the loading position on the guide rails with front supporting elements disposed essentially at the front end of the platform, as well as with rear supporting elements disposed essentially in the center of the platform. During a second section of the lowering motion, only the front supporting elements are guided in the corresponding guide rails, while the rear supporting elements are supported over articulated guide bars. During the section of the lowering motion, in which the rear supporting elements do not rest on the assigned guide rails, the articulated guide bars cause the rear supporting elements to move approximately linearly. The guide rails, assigned to the front supporting elements, end essentially at the rear end of the lower parking place at a level equal to half the height of the platform in its parked position. In its loading position, the platform assumes an inclined position with a slope of about 10°.

A further mechanical parking facility, in which the upper parking place is formed by a platform, which can be lowered from a parked position, disposed above the lower parking place, into a loading position essentially level with the driveway, is known from the German Auslegungsschrift 1140697. In the case of this parking facility, the platform is also supported by means of supporting elements on guide mils and, in its loading position, assumes a position with an appreciable slope. The engine of the parked vehicle is used to move the platform out of the loading into the parked position and the reverse, in that an appropriate driving mechanism is provided, on which the driving wheels of the vehicle act.

A further mechanical parking facility with two parking places disposed one above the other is known from the German Design Patent 1904755. The platform of the upper parking place is supported in this parking facility on in each case two rails, of which one pair is assigned to the front supporting elements and a further pair to the rear supporting elements of the platform. In the case of this parking facility also, the platform assumes a position in its loading state with a considerable slope relative to the horizontal driveway.

It is a disadvantage of all three of the aforementioned parking facilities that the platform, in its loading state, assumes a position with a considerable slope. This is not only detrimental to the comfort of the driver, but the slope of the platform in the loading position furthermore also leads to an appreciable expense, in order to take into account the safety requirements since, on the one hand, the platform must be considerably wider than the vehicle that is to be parked, so that the driver, when entering or leaving the vehicle, can step onto the platform next to the vehicle; moreover, a railing or the like must be provided in order to ensure that the driver, when entering or leaving the vehicle, does not fall from the side of the platform which, in the region of the door on the driver's side, is at an appreciable height above the level of the driveway. For the parking facility of the German Design Patent 1904755, a pit must moreover be excavated for the lower parking place.

A mechanical parking facility is known from the German Offenlegungsschrift 4114746, for which the upper parking place is formed by a platform, which is also guided in guide rails. The guide rails have vertical and horizontal sections, In order to lower the platform from its parked position into its loading position, it is first moved horizontally to the rear and subsequently vertically downward. Conversely, the movement of the parking platform from its loading position into its parked position is composed of a vertical movement and a subsequent horizontal movement. Disadvantages of this puking facility are, in particular, the high power that the driving mechanism must have for the vertical movement of the platform carrying the vehicle, as well as, furthermore, the extremely high stiffness required because of the projecting mounting of the platform.

Further mechanical parking facilities are known from the Ocrman Design Patents 8413121.7 and 9215549, as well as from the German Offenlegungsschriften 3535291 and 2560463. The German Design Patent 8413121.7 discloses a mechanical parking facility, for which the lower parking place is disposed at ground level and the platform is carried on two supports and can be moved vertically. However, the platform can be lowered into its loading position only when the lower parking place is not occupied. The two parking places thus are not independent of one another. In the case of the mechanical parking facility of the German Offenlegungsschrift 3535291, on the other hand, two platforms are provided, which are disposed one above the other and which can be moved coupled to one another; it is thus possible to drive on either of the two parking places independently of the other. However, in setting up the corresponding garage, a pit of considerable depth must be excavated. The same is true for a garage with the mechanical parking facility known from the German Offenlegungsschrift 2560463. Finally, from the German Design Patent 9215549.9, a two-story garage with two stationary parking places disposed one above the other is known. This garage makes do with a pit of lesser depth. This is accomplished owing to the fact that the garage door at the same time functions as an access ramp for the upper parking place.

SUMMARY OF THE INVENTION

It is an object of the present invention to provide a generic, mechanical parking facility with two parking places, which can be used independently of one another and for the construction of which it is not necessary to excavate a pit. At the same time, the parking facility is to fulfill the highest requirements with respect to comfort and safety at the lowest possible costs and in a minimum of space.

Pursuant to the present invention, this objective is accomplished owing to the fact that the guide rails are formed commencing essentially at the rear end of the lower parking place and the platform has wheels in the region of its rear end and, during the second part of the lowering motion of the platform, the wheels rest on the driveway and the load is removed from the rear supporting elements.

These distinguishing features make it possible that the platform, which is guided in the guide rails by means of the front supporting elements, is pulled out completely for loading and unloading directly behind the lower parking place and lowered there into a horizontal or essentially horizontal position. By these means, the inventive parking facility makes do with a minimum of available space. The invention furthermore increases comfort appreciably compared to such generic parking facilities of the state of the art, for which the platform slopes relatively much during loading and unloading. Many drivers consider it to be much more pleasant to drive on or off a horizontal platform than to drive on or off a platform with a slope.

When the inventive parking facility is installed in a free-standing garage, it is possible to drive on or off the upper parking place conveniently even if the garage is relatively narrow, since the platform is loaded in its loading position outside of the garage. The platform need not be wider than the vehicle, which is to be parked on it, because the driver, when entering and leaving the vehicle, need not step onto the platform next to the vehicle. Garages, equipped with the inventive parking facilities, can thus be narrower than those of the state of the art and, in a basement or underground garage of fixed dimensions, correspondingly more parking spaces can be accommodated. Moreover, entering and leaving the vehicle not only is convenient but also particularly safe, because persons, when entering or leaving the vehicle, cannot fall from the platform even in the absence of satiety devices such as rails or the like, because the platform, in the loading position, essentially is horizontal and at the level of the driveway. It is thus possible to step out of the car directly onto the driveway.

A further essential of the inventive parking facility consists therein that the platform of the upper parking space, which in its loading position is essentially at the level of the driveway and horizontal, can be driven on transversely to its longitudinal direction (from the side). This advantage comes to the fore particularly in the case of parking stations in basement or underground garages, in which the parking facilities in each case are designed for four vehicles, each platform thus accommodating two vehicles. In the case of such a parking facility, the two lower parking places are driven on in the longitudinal direction (from the rear) and the two upper parking places, on the other hand, are driven on transversely (from the side). This permits the largest possible number of vehicle parking places to be accommodated in basement or underground garages, in which there are tight space relationships, Known generic parking facilities, in which the upper parking places can be driven on only in the longitudinal direction because of the slope of the platform in the loading position, required correspondingly considerably more space for maneuvering the vehicles so that these can be driven from the rear onto the platform lowered behind the lower parking places.

The rear supporting elements for the platform can also be guided in guide rails, being raised from these while the rear end of the platform is resting on the driveway. In this case, the supporting elements are permanently connected with the platform. By these means, a good relatively uniform distribution of the load of the platform over the four supporting elements can be achieved. Pursuant to a particularly preferred development of the invention, however, the rear supporting elements for the platform are disposed stationarily and, moreover, below the guide rails. For this embodiment, the platform, resting on the supporting elements, is shifted during the lowering from the parked position into the loading position during the first part of the lowering motion, until the rear end of the platform rests on the driveway, the platform being raised from the stationary rear supporting elements as the lowering motion is continued. During the second part of the lowering motion, the platform rests with the front supporting elements on the guide rails and with the wheels, disposed at its rear end, on the driveway. The last-described arrangement of the rear supporting elements enables space to be utilized optimally.

All known forms of roller bearings and friction bearings come into consideration as supporting element for the platform.

The course of motion of the platform, as it is lowered from its parked position into its loading position, is thus as follows for the two embodiments described above. The platform, resting on all four supporting elements in the parked position, is moved towards the rear by the driving mechanism. At the same time, it slopes increasingly downward and towards the rear. When the rear end of the platform rests on the driveway, the load is removed from the rear supporting elements, so that the platform, as it continues to move, moves downwards with the front supporting elements onto the guide rails and rests with its rear end on the driveway. Due to the guidance of the assigned supporting elements, the front end of the platform is furthermore lowered in the guide rails until the platform, in the loading position, assumes a position that is inclined only slightly or even is horizontal.

The guide rails may have an angular course, with an inclined section and an essentially horizontal section. For a particularly advantageous further development of the inventive parking facility, however, arched, downwardly-curved guide rails are provided. The motion of the platform, resulting from guide rails so curved, is particularly well adapted to a vehicle parked on the lower parking place as well as to one parked on the platform in the sense that a garage, with a corresponding parking facility, can make do with a minimum overall height. In particular, as the platform moves from its loading position into the parked position, the vehicle parked on it is raised at the front until it has a maximum slope, in which position it is driven forward at an angle, until the mar supporting elements for the platform are put under load, the front part of the vehicle being moved relatively close to and along the ceiling of the garage, whereupon, when the front supporting elements pass over the apex of the guide rails, the front pan of the vehicle is lowered and the rear part raised further, until the roof of the vehicle is close to the ceiling of the garage.

The front supporting elements advantageously engage essentially the end of the platform. By these means, a maximum space above the lower parking place, which is not traversed by the platform, results. If they are mounted in a stationary fashion, the rear elements are disposed advisably closely below the guide rails. This represents an optimum placement from static as well as kinematic points of view.

Advisably, the supporting elements comprise rollers, which run on assigned running surfaces of the guide rails and optionally of the platform. The guide rails advisably have a U-shaped cross section, the opening of the U in each case pointing laterally towards the inside.

In the case of a particularly advantageous further development of the inventive parking facility, provisions are made that the motor of the driving device is also disposed on the platform. Two chain wheels, coupled together by means of a shaft, are disposed on the sides of the platform and driven by the motor. The chain wheels engage chains, which run along the guide rails. In the case of U-shaped guide rails, the chains advisably are placed in their cavity. The two wheels, engaging the chains, can be assigned spatially to the front supporting elements. The driving motor advantageously is also disposed in this area. This results in a space-saving and protected arrangement of the driving mechanism.

The inventive parking facility can be designed particularly for parking two or four motor vehicles. In the latter case, it has two lower parking places side by side and a parking platform having two parking places side by side. As already described further above, the parking places on the platform can extend in the longitudinal or the transverse direction, depending on the local space relationships for the driveway. Parking facilities with four parking places can be provided particularly in larger parking installations. However, the inventive parking facility is suitable with special advantages for installation in a free-standing garage. In this case, the guide rails, instead of being fastened by means of special supports, are advisably fastened to the side walls of the garage housing the parking facility. By these means, the cost of supporting the guide rails is a minimum and the stability of the parking facility a maximum.

Particularly when the available space makes a narrow garage necessary, the lower parking space can also be provided with an extendible platform on which the vehicle is parked outside of the garage and which is then moved onto the lower parking space. In this case, because it is not necessary to open the doors of the vehicle parked in the garage, the clear width of the garage need exceed only slightly the width of the vehicle to be parked.

BRIEF DESCRIPTION OF THE DRAWINGS

In the following, the invention is described in greater detail by means of a drawing. This drawing shows a preferred embodiment of the inventive parking facility within a free-standing garage, wherein.

DESCRIPTION OF PREFERRED EMBODIMENTS

Figure 1:
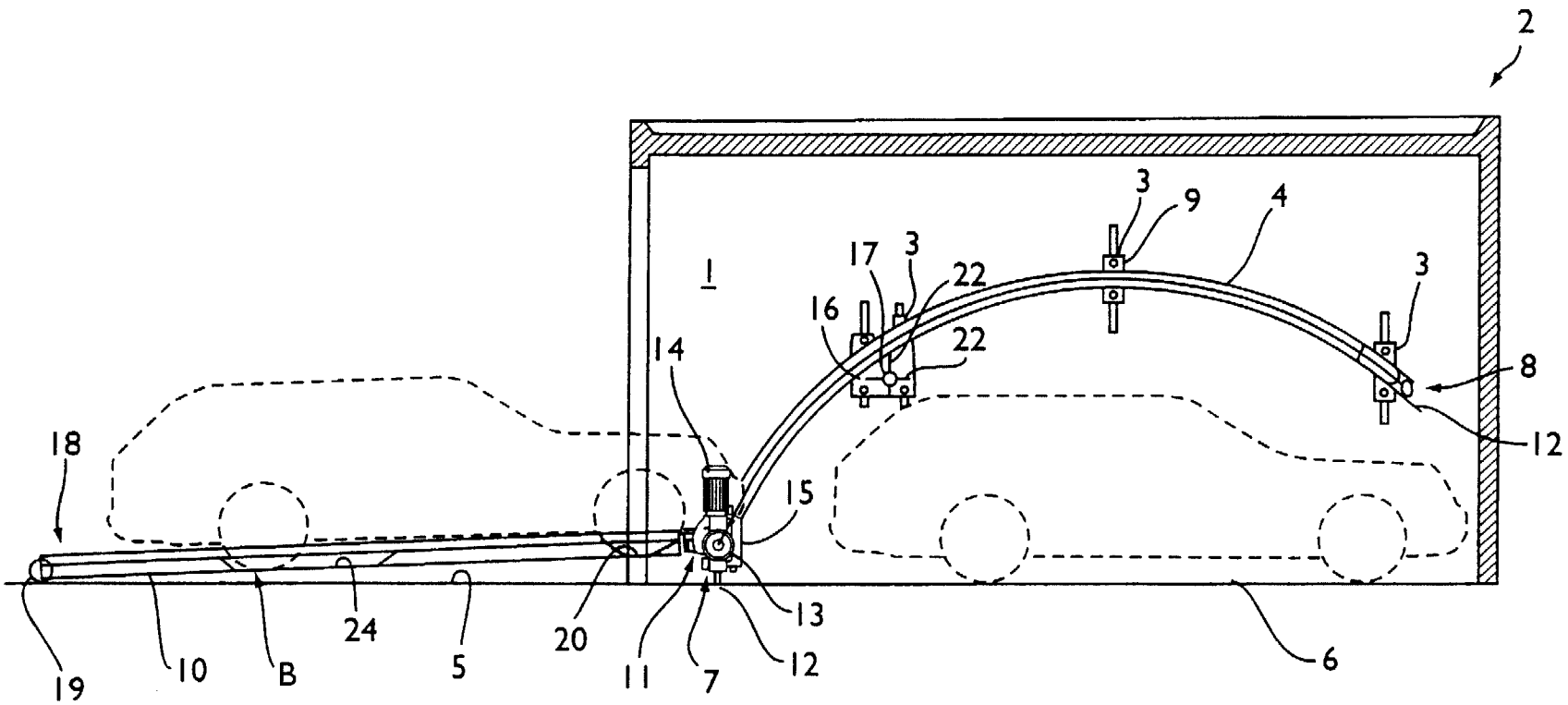
FIG. 1 shows the platform in its lowered, loading position
Figure 2:
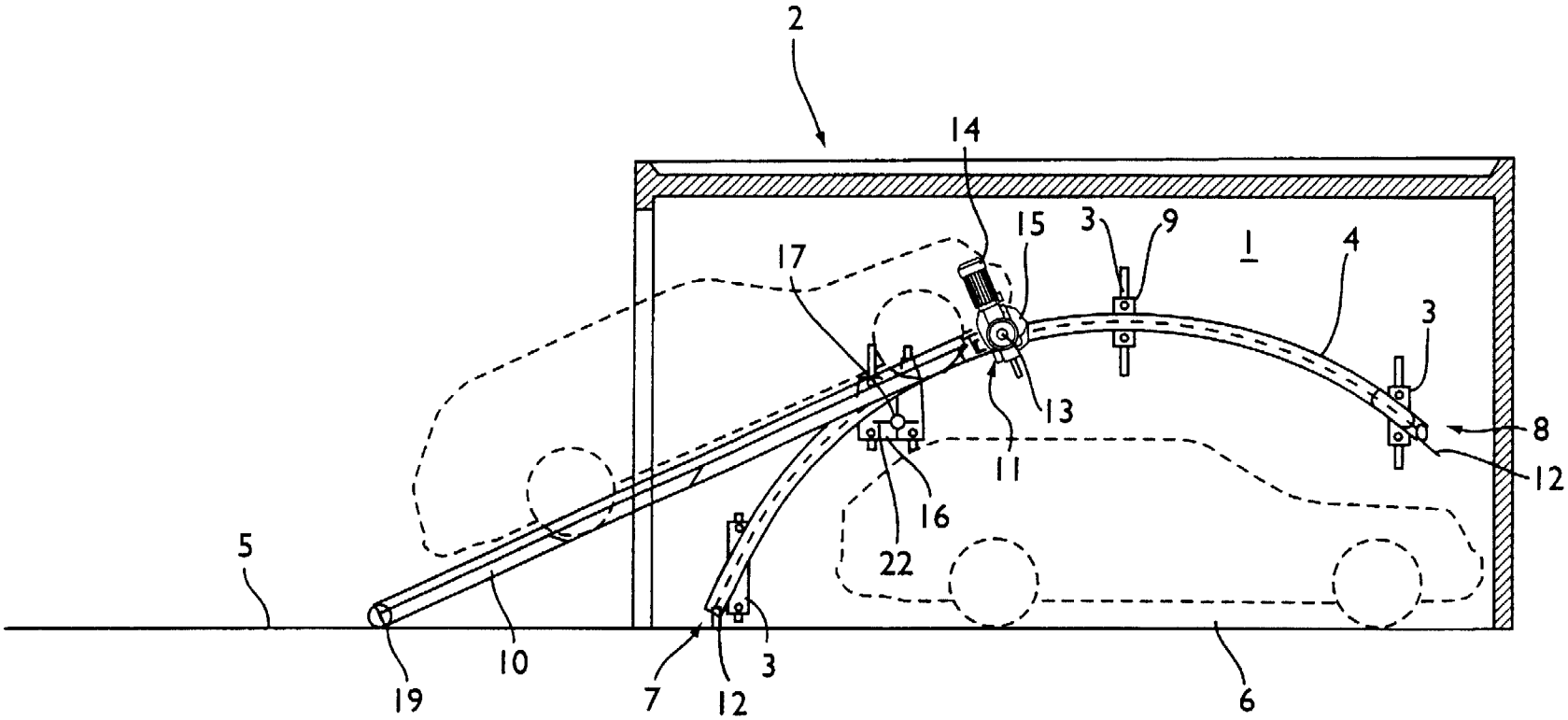
FIG. 2 shows the platform while it is being moved out of its loading position into its parked position.
Figure 3:
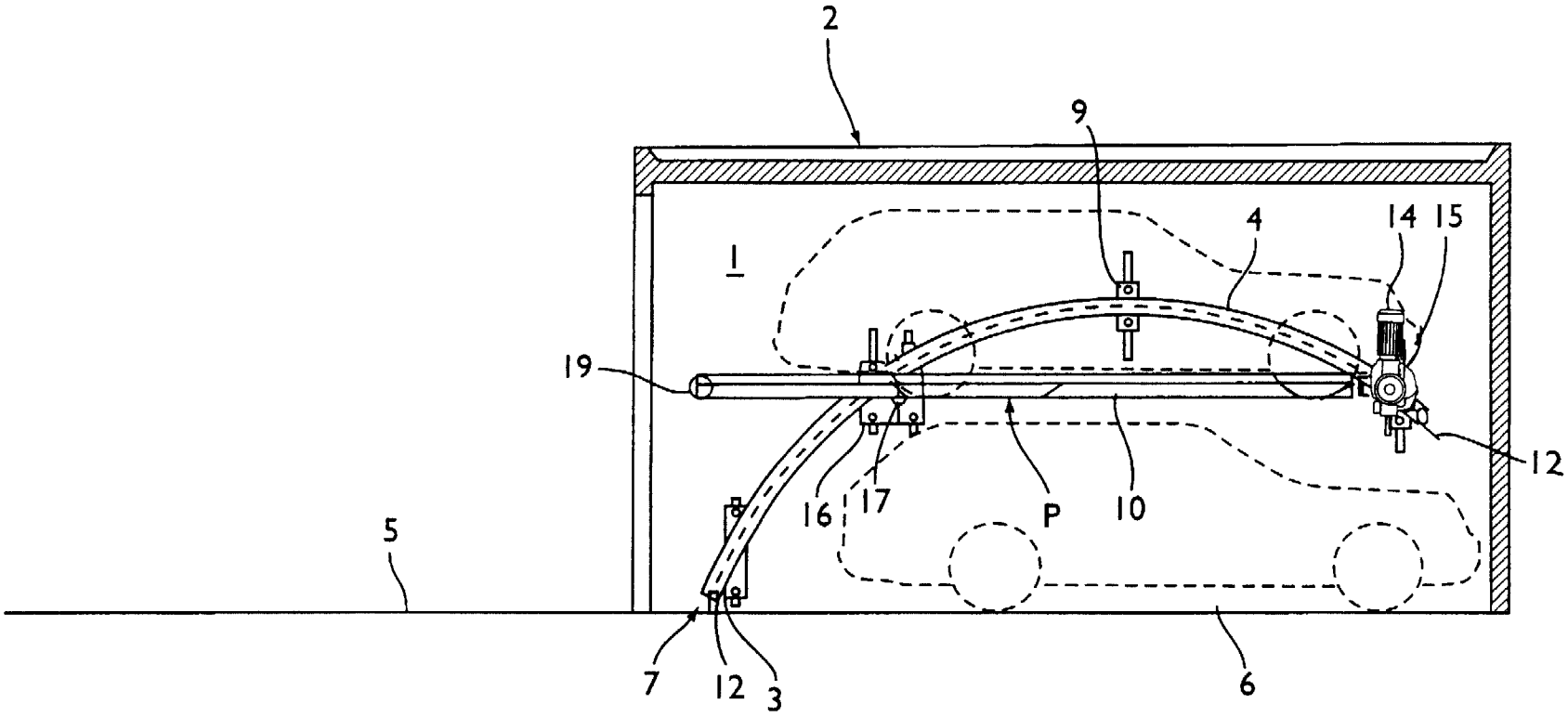
FIG. 3 shows the platform in its parked position.

At each side wall 1 of the garage 2, shown in longitudinal section in FIGS. 1 to 3, a guide rail 4 is fastened by means of a plurality of fastening plates 3. The guide rail 4 has an arched, downwardly-curved course. It proceeds above the lower vehicle parking place 6, which is disposed at ground level, that is at the level of the driveway 5. The guide rail 4 extends from a point 7 approximately at the level of the driveway 5 at the rear end of the lower parking place 6 up to a point 8, which is above the front part of a motor vehicle, parked on the lower parking place 6. The curvature of the guide rail 4 is such that it has an apex 9 approximately above the center of a vehicle parked on the lower parking place 6.

Figure 5:
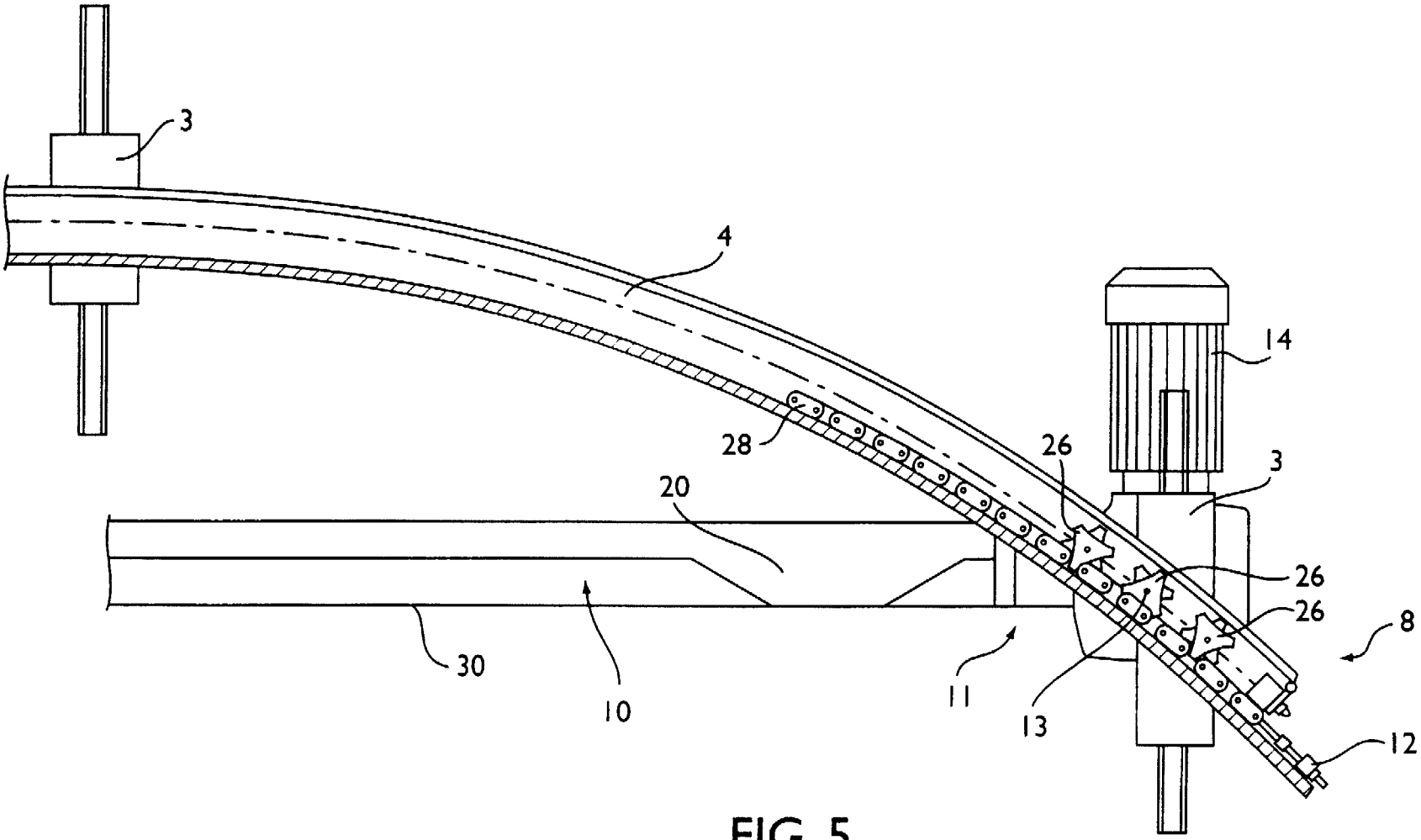
FIG. 5 shows a fragment of a guide rail structure in section.

The upper parking place is formed by a platform 10. The front end 11 of the platform is guided in the two guide rails 4. The front supporting elements, which serve to guide the platform 10, comprise on either side in each case three consecutive chain wheels 26 (FIG. 5), which roll on a chain 28, which is fixed between two chain tension adjusters 12 that are provided at the end points 7 and 8 of the guide rail 4 and runs in the interior of the U-shaped guide rail 4. Of the three chain wheels 26 of each supporting element, the middle one is driven. The two driven chain wheels on the platform 10 are connected together by means of the shaft 13 to ensure that they run synchronously. The shaft 13 is driven by the drive motor 14 over a reduction gear. When the drive motor 14 is switched on, the front end 11 of the platform 10 therefore moves along the guide rails 4.

Furthermore, at each side wall 1 of the garage 2, an end piece 16 is fastened, which in each case carries a supporting roll 17. The supporting rolls 17 protrude inwards to such an extent in the direction of the interior of the garage, that the underside 30 of platform 10, extending between the two guide rails 4, rests essentially on them in the parked position P (FIG. 3).

At its rear end 18, the platform 10 has two wheels 19, with which it rests in its loading position B (FIG. 1) on the driveway 5. In order to secure the position of the vehicles parked on it, the platform 10 furthermore has troughs 20 and 21 for the front and rear wheels of the parked vehicle. Trough 20 for the front wheels is dimensioned in the longitudinal direction of the platform 10 so that the position of the front wheels for all parked vehicles is the same. On the other hand, trough 21 for the rear wheels extends in the longitudinal direction of the platform so that the rear wheels of all current passenger cars find space in it despite the different wheelbases of these vehicles.

If the platform 10 has been laden in its loading position B (FIG. 1) with a vehicle, which is to be parked, and all persons have left the vehicle, the drive motor 14 is switched on. The front end 11 of the platform 10 is moved forwards and upwards by these means in the guide rails 4. The rear end 19 of the platform 10 is consequently pulled on the driveway, the wheels 19 preventing damage to the platform and/or to the driveway. As the platform 10 continues to be shifted in the guide rails 4 beyond the position shown in FIG. 2, the platform 10, with the guide surfaces disposed at its underside 30, contacts the supporting rolls 17. Upon further continuation of the shifting movement of the platform 10, the latter is supported on the supporting rolls 17, the rear end 18 of the platform is raised. In order to transfer the maximum load on the supporting roll 17, which occurs in this instant, onto the side wall 1 of the garage, the supporting roll shaft is fastened at the end piece 16 by means of four solid reinforcing ribs 22. The platform, carried by the front supporting elements and by the rear supporting roll 17 functioning as rear supporting elements, is moved further, until it assumes its essentially horizontal parked position P (FIG. 3).

For bringing the vehicle, parked on the platform 10, from this parked position P (FIG. 3) into its loading position B (FIG. 1), the procedure, described above, is carried out in the reverse sequence.

Figure 4:
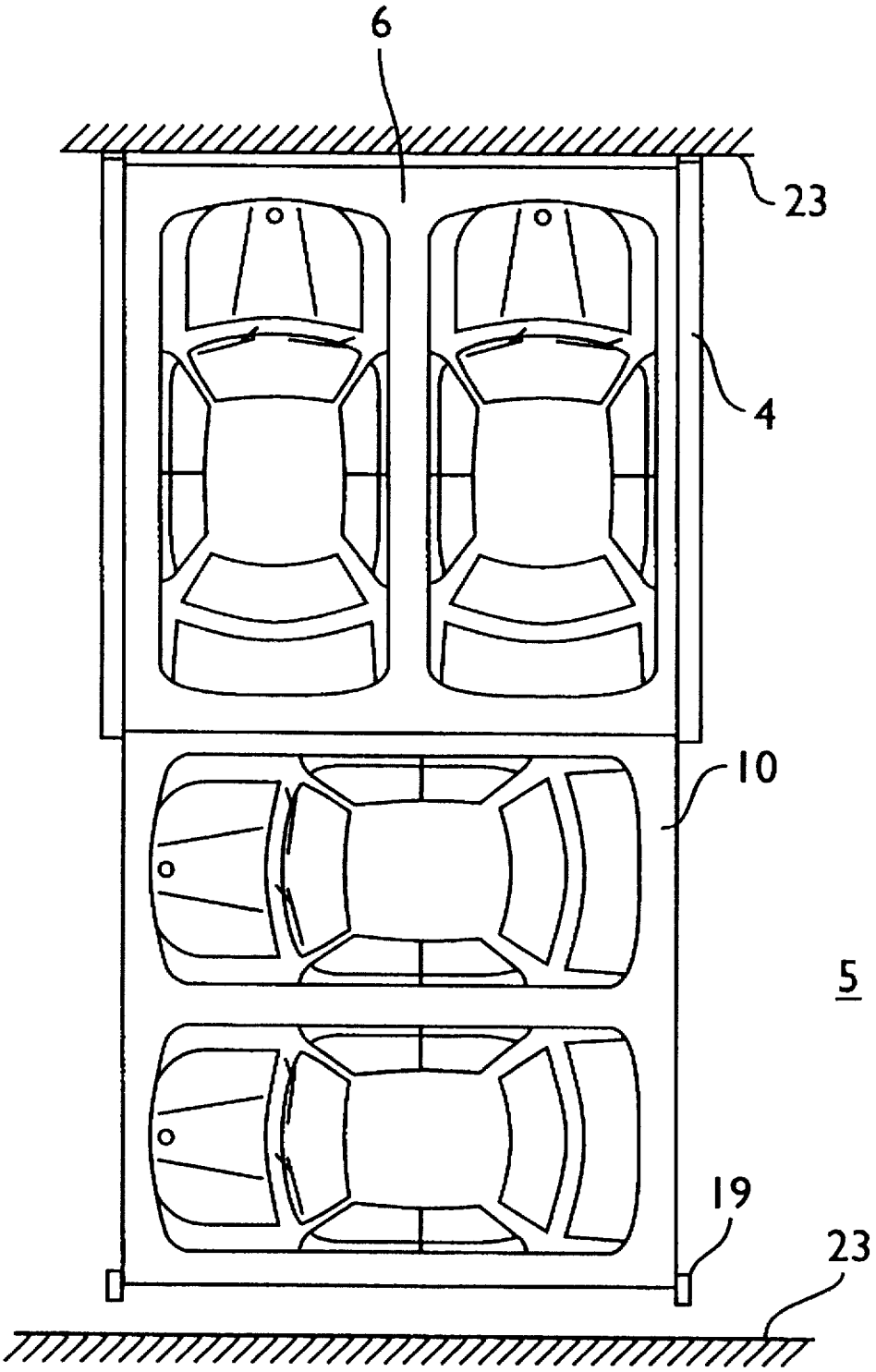
FIG. 4 shows a preferred embodiment of the puking facility with four parking places.

The parking facility, shown in FIG. 4, is designed for parking a total of four passenger cars, namely two on the lower parking space 6 and two on the platform 10, The vehicle is driven from the side onto the platform 10, which, in the lowered loading position shown, is completely behind the lower parking place 6 and essentially at the level of the driveway 5. On the other hand, the vehicle is driven onto the lower parking place 6 from the rear, with the platform raised. By these means, it is possible to drive onto all four parking areas even when the space relationships are relatively tight, as indicated by the two walls 23.

The mechanics for raising the platform 10 into its parked position, in which it is above the lower parking place 6, is essentially that described in connection with FIGS. 1 and 3. It therefore need not be explained once again here.

Figure 6:
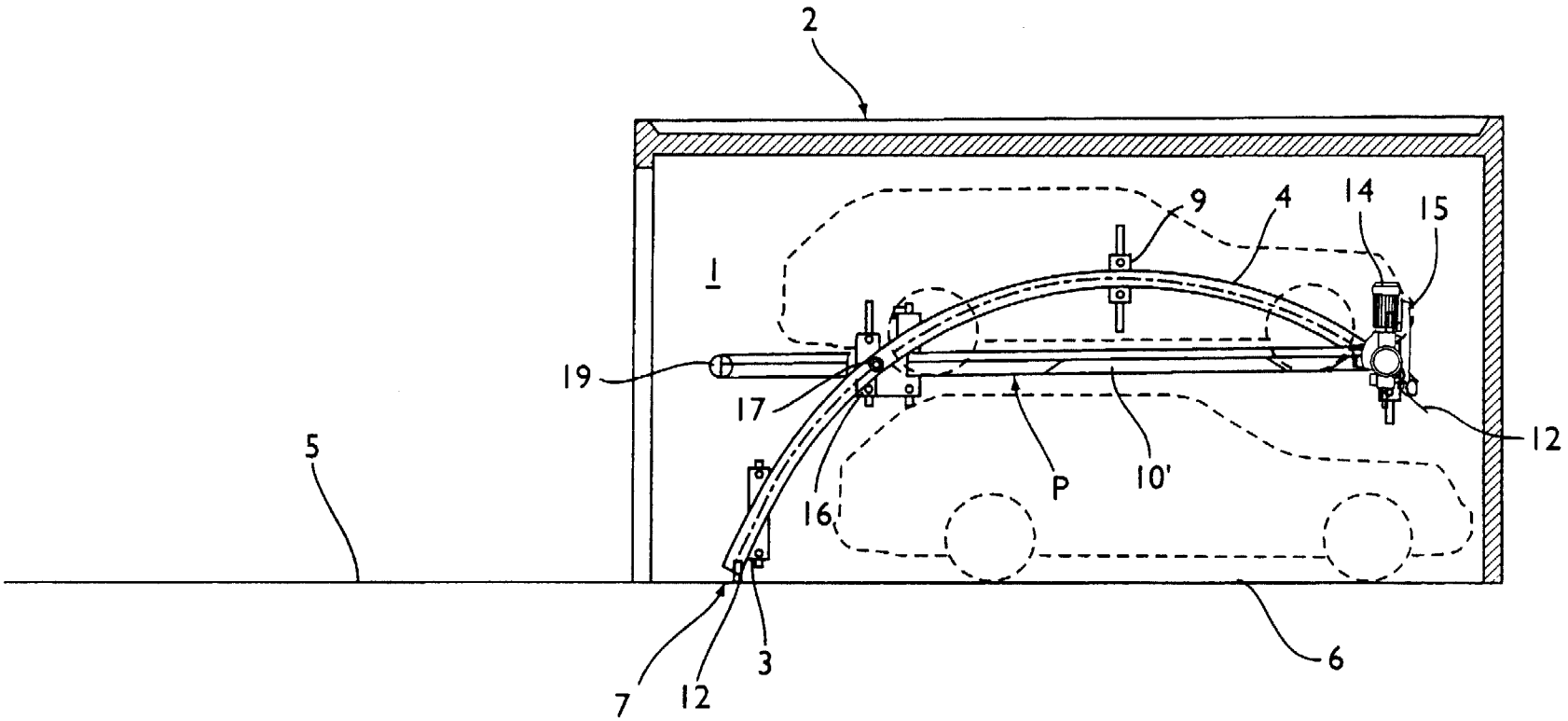
FIG. 6 is similar to FIG. 3 and shows an alternative embodiment of the invention.

FIG. 6 is an alternative embodiment of a parking facility in accordance with the invention that is substantially similar to the embodiment of FIGS. 1–3. FIG. 6 illustrates the position of vehicles corresponding to FIG. 3 of the first embodiment. Instead of attaching to the walls for example, of a garage, in the embodiment of FIG. 6, rear supporting elements 17' are connected on opposite sides of the platform 10', nearer to the rear end than to the front end. The rear supporting elements 17' are guided in the guide rails 4 but become separated from the guide rails when the platform 10' is in a position as illustrated for the first embodiment in FIG. 1.

With this construction, a good relatively uniform distribution of the load on the platform is achieved over the four supporting elements at the front end and near the rear of the platform 10'. However, the positioning of the rear support elements 17 as illustrated in FIGS. 1–3 is preferred.

I claim:

1. A mechanical parking facility having a length direction and a width direction and at least a first parking space and a second parking space, comprising:

a pair of fixed guide rails spaced apart in said width direction and extending generally parallel in said length direction, said rails each having a first portion approximately at a level of a driveway and a second portion that is elevated above said driveway level;

a moveable platform for carrying a vehicle, and having a front end and a rear end, said platform having contact means in the region of its rear end for contact on said driveway, said platform being moveable from a lower position to an elevated position;

a driving mechanism for connecting between said fixed guide rails and said moveable platform, said drive means causing reversible motion of said platform lengthwise along said guide rails, said front end of said platform following contours of said guide rails and being reversibly moveable from said first portions of said guide rails at said driveway level to said elevated second of said fixed guide rails by operation of said driving mechanism, said guide rails being contoured to position said platform substantially horizontally when said platform front end is at said first portions of said guide rails, and when said platform front end is at said second portions of said guide rails;

rear supporting means, fixed in position relative to said guide rails and elevated above said driveway level, said rear supporting means supporting said platform substantially horizontally by contact in between said front and back ends of said platform when said front end of said platform is at said second elevated portions of said guide rails;

said contact means in the region of said rear end of said platform and said guide rails supporting weight including said platform and objects thereon when a vehicle is entered onto said platform at said lower position, said rear supporting means and said guide rails supporting the weight including said platform and objects thereon when said platform is horizontal and elevated;

said guide rails being contoured to transfer said platform weight between said contact means and said rear supporting means by raising said contact means from said driveway level as said platform is elevated from said driveway level, and vice versa;

said contoured guide rails also providing said first parking space for a vehicle below said substantially horizontal and elevated platform, and said second parking space, for a vehicle that is resting on said horizontal and elevated platform, above said first parking space;

said front end of said first platform tilting above said rear end of said platform when said platform is in transition between said lower position and said elevated position.

2. The mechanical parking facility of claim 1, wherein the guide rails (4) are arched and curved.

3. The mechanical parking facility of claim 1, wherein said driving mechanism engages essentially the front end (11) of the platform (10).

4. The mechanical parking facility of claim 1, wherein the rear supporting means include supporting rolls (17), which are stationary and disposed below the guide rails (4) and over which rolls the platform (10) is moved.

5. The mechanical parking facility of claim 1, wherein the rear supporting means include supporting rolls, which are connected with the platform and guided during a part of platform lowering by the guide rails.

6. The mechanical parking facility of claim 1, wherein the driving mechanism includes a motor (14) disposed on the platform.

7. The mechanical parking facility of claim 6, wherein the driving mechanism includes two chains, fixed along the guide rails (4) and engaged by at least two chain wheels, two of said chain wheels being coupled for rotation together and coupled to the motor.

8. The mechanical parking facility of claim 1, wherein the guide rails (4) are fastened to side walls (1) of a garage (2) housing the parking facility.

9. The mechanical parking facility of claim 8, wherein end pieces (16) carry the rear supporting means (17), and are fastened to the side walls (1) of the garage (2).

10. The mechanical parking facility of claim 1, wherein the platform (10) accommodates two vehicles, which extend transversely to the longitudinal direction defined by the direction of said rails.

11. The mechanical parking facility of claim 4, wherein end pieces (16) carry the rear supporting rolls (17), and are fastened to side walls (1) of a garage (2).

12. The mechanical parking facility of claim 1, wherein said contact means are wheels.

13. The mechanical parking facility of claim 1, wherein said first portions of said guide rails essentially start at a rear end of said first parking space.

* * * * *

UNITED STATES PATENT AND TRADEMARK OFFICE

CERTIFICATE OF CORRECTION

PATENT NO. : 5,593,266

DATED : Jan. 14, 1997

INVENTOR(S) : Vinzenz WURZINGER

It is certified that error appears in the above-identified patent and that said Letters Patent is hereby corrected as shown below:

On the Title page; item (73) should be corrected as follows:

Assignee: Vinzenz Wurzinger Maschinenbau GmbH,
Untergriesbach, Germany

Signed and Sealed this

Eighth Day of July, 1997

Bruce Lehman

*Attest:*

BRUCE LEHMAN

*Attesting Officer*

*Commissioner of Patents and Trademarks*